US005160194A

United States Patent [19]

Feldman

[11] Patent Number: 5,160,194

[45] Date of Patent: Nov. 3, 1992

[54] TOOTHBRUSH WITH EXTERNALLY ILLUMINATED BRISTLES

[76] Inventor: Melvin D. Feldman, 1745 Sequoia Ave., Burlingame, Calif. 94010

[21] Appl. No.: 842,617

[22] Filed: Feb. 27, 1992

[51] Int. Cl.[5] ..... A46B 9/04

[52] U.S. Cl. ..... 362/109; 362/253; 362/804; 15/167.1

[58] Field of Search ..... 362/109, 253, 804; 15/167.1

[56] References Cited

U.S. PATENT DOCUMENTS

| | | | |
|---|---|---|---|
| 1,844,588 | 2/1932 | Meitzler | 362/804 X |
| 3,261,978 | 7/1966 | Brenman . | |
| 4,779,173 | 10/1988 | Carr et al. | 362/109 |
| 5,030,090 | 7/1991 | Maeda et al. | 433/29 |

*Primary Examiner*—Allen M. Ostrager
*Attorney, Agent, or Firm*—David Pressman

[57] ABSTRACT

A toothbrush comprises a hollow, tubular handle (11) which holds two batteries. A shoulder (14) at the forward end of the handle contains a high output light bulb (10). A head (17) extends integrally from one side of the shoulder, while a tuft of bristles (12) is attached to the distal end of the head. Electrical conduits made of a series of sleeves within the handle and an externally mounted bow spring switch (18) constitute a normally open circuit. Holding the toothbrush automatically compresses the switch to turn on the light bulb. When the head and bristles are placed in the mouth, the light bulb projects a beam of bright light across open space onto the external surfaces of the bristles, teeth and plaque. Thus the visibility of the teeth and plaque is greatly improved to facilitate brushing. In addition, the illumination produces a very appealing visual effect which will induce children to brush more frequently and for longer durations. The brush uses conventional bristles which are illumianted in use and which can extend into the sulcus and other crannies for highly effective brushing and plaque removal.

20 Claims, 1 Drawing Sheet

TOOTHBRUSH WITH EXTERNALLY ILLUMINATED BRISTLES

BACKGROUND

1. Field of Invention

This invention relates generally to oral hygiene, specifically to an improved toothbrush for effecting improved oral hygiene.

2. Prior Art

Among the hundreds of diseases that humans suffer, one of the most common is dental caries, or tooth decay, and periodontal disease. These diseases are mainly caused by plaque on the surfaces of teeth and in the grooves (sulcus) between the teeth and the gums. Plaque is a mucus or slime that consists of bacteria and food particles left over from meals and snacks. The bacteria, which are always present in the mouth, multiply, feeding on residual sugars which are left in the mouth after eating. They form "bacteria cities" or plaque which contains acids that attack tooth enamel to produce cavities in teeth. In addition, the plaque also hardens to form calculus, which, when present in the sulcus, irritates the gums, causing periodontal (around the tooth) disease or gingivitis (gum disease) which can result in receding gum lines and eventual loosening and loss of teeth.

The best known prevention of tooth decay and gum disease is regular and thorough tooth brushing and sulcus cleaning. Although almost everyone in advanced societies has a toothbrush, tooth decay and gum disease are still prevalent afflictions in these societies. Several factors contribute to the problems: Some people do not use their toothbrushes properly, some do not brush for sufficient duration, some have trouble seeing plaque and therefore cannot remove it efficiently, while some, especially children, dislike brushing so much that they brush infrequently.

A few special toothbrushes have been designed in the past in attempts to help improve brushing habits. U.S. Pat. No. 3,261,978 to Brenman (1966) shows a toothbrush with LEDs (Light Emitting Diodes) or miniature light bulbs in the head or handle to illuminate the transparent back side of the head. But because the light from the back of the head shines away from the bristles, it cannot illuminate the teeth and plaque while brushing to improve brushing effectiveness. U.S. Pat. No. 4,779,173 to Carr et al. (1988) shows a toothbrush with light conducting optical fiber "bristles" illuminated by light projected against the roots of the bristles by a light source in the hollow handle. Because the light is projected at a right angle against the fibers' roots, only a very tiny portion of the light is transmitted through the fibers, resulting in insufficient illumination of the teeth and plaque. Also the individual bristles are relatively thick, precluding them from extending into the sulcus and removing the plaque therewithin.

U.S. Pat. No. 5,030,090 to Maeda et al. (1991) shows a brush similar to Carr's, but with optical fibers bent at right angles within the head so that their roots can be gathered and positioned directly in line with a light source. Because optical fibers have minimum allowable bend radii, and because the fiber bundle is quite thick, the head of the toothbrush must be very thick to accommodate the bend in the fiber bundle. This can significantly impede brushing, especially for small children. Furthermore, optical fiber is stiffer and much more expensive than the type of bristles normally used for toothbrushes. A toothbrush with stiff, expensive optical bristles can be very uncomfortable and uneconomical to use and, again, is unable to clean the sulcus effectively.

Thus these devices either cannot illuminate the teeth and plaque while brushing to improve brushing effectiveness, or cannot produce sufficient illumination without the use of a thick head portion. In addition, some are much more expensive and much more uncomfortable than conventional toothbrushes. Finally, their bristles are too thick to brush effectively.

OBJECTS AND ADVANTAGES

Accordingly, several objects and advantages of the invention are to provide a toothbrush which will effectively illuminate the teeth and plaque while brushing to improve their visibility and therefore also improve brushing efficiency, which will effectively illuminate the bristles and teeth simultaneously to create an interesting visual effect which will appeal to children to induce them to brush more frequently, which has a conventional thin head, which is easy to operate, which is easy and secure to grip, which is comfortable to use, which is economical to produce and opeate, and which is convenient to store, and which has thin, conventional bristles so as to be able to brush the sulcus with high efficacy.

Further objects and advantages will become apparent from a study of the following description and the accompanying drawings.

DRAWING FIGURES

Figure 1:
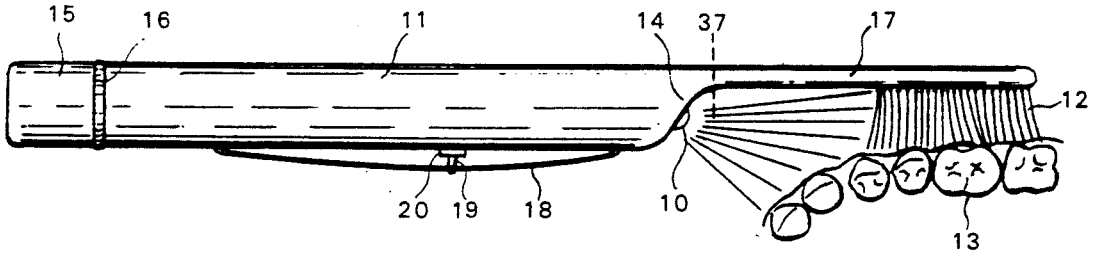
FIG. 1 is a side view of a toothbrush and light combination (hereafter known as toothbrush) in accordance with the invention.
Figure 2:
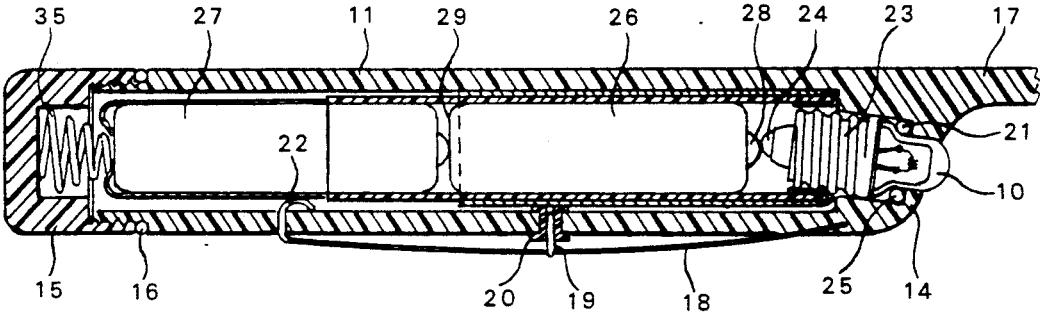
FIG. 2 is a partial sectional side view of the toothbrush of FIG. 1.
Figure 3:
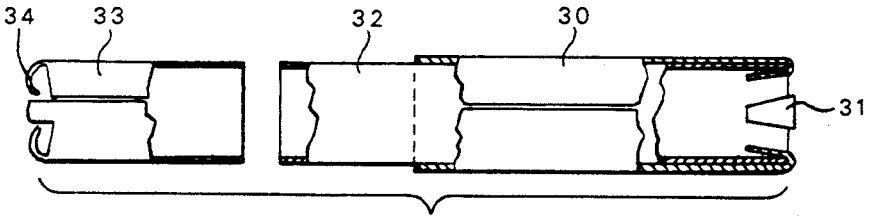
FIG. 3 is a partial sectional and exploded side view of the battery sleeves in FIG. 2.
Figure 4:
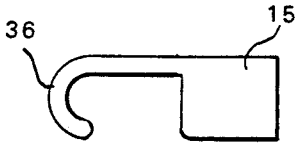
FIG. 4 is a side view of another embodiment of the end cap of the toothbrush of FIG. 1.

| Drawing Reference Numerals | |
|---|---|
| 10. Light Bulb | 11. Handle |
| 12. Bristles | 13. Teeth |
| 14. Shoulder | 15. End Cap |
| 16. O-Ring | 17. Head |
| 18. Bow Spring | 19. Plunger |
| 20. Washer | 21. O-Ring |
| 22. End Contact | 23. Threaded Case |
| 24. Tip Terminal | 25. Transition |
| 26. Forward Battery | 27. Rearward Battery |
| 28. Positive Terminal | 29. Negative Terminal |
| 30. Front Sleeve | 31. Forward Tabs |
| 32. Insulator Sleeve | 33. Rear Sleeve |
| 34. Rear Tabs | 35. Coil Spring |
| 36. Hook | 37. Detachment Line |

DESCRIPTION—FIG. 1

In accordance with a preferred embodiment of the invention shown in FIG. 1, a toothbrush has a light bulb 10 in handle 11 for illuminating bristles 12 and teeth 13 to improve brushing efficency and to create an interesting visual effect.

Tubular plastic handle 11 has an angled and rounded shoulder 14. Handle 11 is generally thicker than conventional toothbrushes to provide an easier and more secure grip. The rear end of handle 11 is closed by an end cap 15. An O-ring 16 is compressed between the opposing rims of handle 11 and end cap 15 to provide a watertight seal. A head 17 in the shape of a long, flat bar, extends integrally from the upper side of shoulder 14. The distal end of head 17 is rounded to prevent causing any discomfort to the user. A set of tufts of inexpensive, conventional plastic bristles 12 are attached to the distal end of head 17 on the lower side. For example, four rows of ten tufts may be used, with each tuft having about 25 nylon filaments.

Bulb 10 is a high output, krypton gas filled incandescent bulb which has a tip which projects slightly from the center of shoulder 14. A metal bow spring 18, preferably of stainless steel, is attached to the lower side of handle 11 to span most of its length. A metal plunger 19, also of stainless steel, is attached to bow spring 18 near the center to pass orthogonally through the wall of handle 11. Bow spring 18 and plunger 19 serve as the switch. A washer 20, made of the synthetic rubber neoprene, surrounds plunger 19 to provide a watertight seal between plunger 19 and handle 11.

When in use, bulb 10 shines a bright divergent beam of white light, which is slightly angled downwards, from shoulder 14 through open space generally onto the external surfaces of bristles 12 and some of teeth 13. Adults will find that the illumination greatly improves their ability to see teeth 13 and the plaque which may be stained by a disclosing or coloring solution. As a result, the user's brushing efficiency will be greatly improved to better prevent tooth decay and gum disease.

In addition, children will find that the illumination produces a highly appealing visual effect, especially when the plaque is first stained. This tends to make brushing fun and in the nature of a game or challenge to remove all of the stain (and hence the plaque). Therefore, children will brush much more often and for much longer to remove more plaque, produce cleaner teeth, and hence fewer cavities.

Because bristles 12 are illuminated externally, conventional plastic fibers may be used for bristles 12 instead of the expensive optical fibers used in the prior art. This makes the toothbrush very economical, an extremely important attribute in a disposable item. In addition, the freedom to use conventional bristles makes available the various stiffnesses available in conventional toothbrushes, which range from soft to hard to suit individual preferences. Since the individual filaments or nylon strands in the tufts are conventional, they are thin enough to extend into the sulcus, where they will be able to disrupt and remove the plaque and bacteria therein. The toothbrush is economical enough so that when bristles 12 become worn, the entire toothbrush may be replaced. End cap 15 may be permanently attached in this case, so that the brush will be disposed when the batteries run down. Alternatively, cap 15 may be removable so that the batteries can be replaced when discharged. Also, head 17 may be made detachable, along detachment line 37 by using a snap-fit joint, so that only head 17 and bristles 12 are disposed and replaced when the bristles are worn.

DESCRIPTION—FIG. 2

Here the toothbrush is shown in a partial sectional side view. Handle 11 and end cap 15 may be made of a injection molded plastic such as ABS. The rearward end of handle 11 is threaded externally while end cap 15 is threaded internally such that end cap 15 may be screwed onto handle 11. Rubber O-ring 16 is compressed between the forward rim of end cap 15 and an opposing rim on handle 11 to provide a waterproof seal.

A 10 mm wide, outward bowing stainless steel bow spring 18 is mounted on the lower side of handle 11, extending from near shoulder 14 back to about three quarters of the length of handle 11. Bow spring 18 has a straight forward end which is embedded into the wall of handle 11, and a rearward end which passes through the wall of handle 11 to curl back upon the inside surface of handle 11 to form an end contact 22. Plunger 19 has an outer end attached to the center of bow spring 18, and passes orthogonally through the wall of handle 11. Plunger 19 is surrounded by neoprene washer 20, which is held in the wall of handle 11 by its inner and outer flanges, to serve as a waterproof seal between plunger 19 and handle 11. Bow spring 18 may be enclosed with a soft, flexible plastic coating for waterproofing and more comfortable handling.

Bulb 10, which requires 3 volts to operate, has a metal electrical terminal or threaded case 23, and a rearward projection which is tip terminal 24. The glass portion of bulb 10 is generally cylindrical in shape but widens at the base to form a transition 25, around which is disposed a small rubber O-ring 21. Bulb 10 is frictionally fitted within a corresponding cavity in shoulder 14 to expose only the tip of the bulb at the center of shoulder 14. Small O-ring 21 is compressed between transition 25 and an opposing portion of the cavity to provide a watertight seal. Bulb 10 is positioned at a slight downward angle to project its light beam likewise. A lamp with a much lower power consumption but extremely high output such as Radio Shack model 276-086 LED and a suitable series resistor may be substituted for light bulb 10 to produce a much more energy economical illumination, or a xenon lamp, such as Ray-O-Vac T-1, may be used.

Hollow handle 11 houses economical AAA size forward and rearward battery 26 and 27 of 1.5 volts each. The batteries may of the disposable or rechargeable types. They are positioned with their positive terminals 28 forward, and arranged in series such that the negative terminal 29 of forward battery 26 is in contact with positive terminal 28 of rearward battery 27. Thus, the potentials of the batteries are combined such that the electrical potential between positive terminal 28 of forward battery 26 and negative terminal 29 of rearward battery 27 provide the 3 volts required to operate bulb 10. Positive terminal 28 of forward battery 26 is in contact with tip terminal 24 of bulb 10.

A series of loosely fitted tubular sleeves surround threaded case 23 of light bulb 10 and the batteries to serve as electrical conduits. A copper front sleeve 30 has four inwardly folded forward tabs 31 (two visible) which are frictionally fitted around the base of threaded case 23 of bulb 10. Front sleeve 30 extends from light bulb 10 to slightly past the position of plunger 19, which is normally retracted from contacting front sleeve 30 by bow spring 18. A plastic insulator sleeve 32 is loosely fitted between front sleeve 30 and the batteries to extend from the fold in forward tabs 31 to the first third of rear battery 27. A copper rear sleeve 33 is loosely fitted around rear battery 27 to extend from the end of insulator sleeve 32 to the end of rear battery 27 to terminate in four rear tabs 34 which curl onto the surface of negative terminal 29. The lower side of rear sleeve 33 is in contact with end contact 22 of bow spring 18. A coil spring 35 is compressed between rear tabs 34 and the inside of end cap 15 to urge rear sleeve 33, insulator sleeve 32, and front sleeve 30 against threaded case 23 of bulb 10. Coil spring 35 also urges the batteries against tip terminal 24 of bulb 10.

The electrical circuit is normally open, that is, no current will flow when the toothbrush is not in use. The circuit will become closed to energize bulb 10 automatically when the toothbrush is held in a hand because the grip will easily compress bow spring switch 18 to depress plunger 19 against the surface of copper front sleeve 30. Thus, electron current will flow from negative terminal 29 of rear battery 27, through rear sleeve 33, end contact 22, bow spring 18, plunger 19, front sleeve 30, threaded case 23, the filament of bulb 10, tip terminal 24, and into positive terminal 28 of forward battery 26 to complete the circuit. Bow spring switch 18 thus makes the toothbrush extremely easy to operate: Light bulb 10 turns on when the toothbrush is held, and turns off when the toothbrush is released or laid down.

DESCRIPTION—FIG. 3

Here the series of sleeves are shown in a partial sectional and exploded side view to illustrate their construction. Front sleeve 30 and rear sleeve 33 are both made from rolled flat sheets of copper. Front sleeve 30 has four forward tabs 31 (three visible) folded inwardly about −170 degrees from its forward end, while rear sleeve 33 has four rear tabs 34 (three visible) folded inwardly about 100 degrees from its rearward end. Plastic insulator sleeve 32 is loosely fitted within front sleeve 30 to extend from the folds in forward tabs 31 to the outside of front sleeve 30. Rear sleeve 33 is of the same diameter as insulator sleeve 32.

DESCRIPTION—FIG. 4

An alternative end cap 15 is shown with a hook 36 integrally attached to the rim. Hook 36 allows the toothbrush to be conveniently hung from wall hooks or other objects in the bathroom.

In another alternative embodiment (not shown) bristles 12 are vibrated or rotated by a built-in electric motor, by techniques well known in the art, for further enhancing brushing efficiency.

In one embodiment the toothbrush is 17 mm in diameter with other parts sized proportionately.

SUMMARY, RAMIFICATIONS, AND SCOPE

Accordingly the reader will see that I have provided an improved toothbrush which simultaneously and effectively illuminates the external surfaces of the bristles and teeth while brushing. It has a thin, comfortable head because the light source is on the handle's shoulder, but does not rely on the interior of the head to conduct light. It allows the teeth and plaque to be seen much more easily. As a result brushing efficiency is greatly improved to reduce tooth decay and gum disease. It produces an interesting visual effect which children will find very appealing to induce them to brush more frequently and for longer durations. It is extremely easy to operate because it turns on automatically when picked up, and turns off automatically when laid down. It provides an easy and secure grip because of its relatively thick handle. It uses conventional bristles which may be very soft to maximize comfort and which can reach into the sulcus to disrupt plaque. It is economical to produce because it uses inexpensive conventional bristles instead of expensive optical fibers. It is economical to operate because it uses inexpensive small batteries which may be rechargeable. It is convenient to store because it offers a hook for hanging on bathroom walls.

While the above descriptions are specific, they should not be considered as limitations on the scope of the invention, but only as examples of the preferred embodiment. Many other ramifications and variations are possible within the teachings of the invention. For example, different materials may be used for the handle, bristles, and electrical conduits. Different types of batteries may be used. Different switch mechanisms and circuits may be used. Different electrical conduits that do not use sleeves may be employed. The head/bristles assembly may be detachable so they may be easily and economically replaced when worn. In lieu of batteries, power for energizing lamp 1 may be provided by a power cord connected to a rechargeable battery pack, or to a mains supply, preferably via a step-down transformer, and optionally a rectifier.

Thus the reader is requested to determine the scope of the invention by the appended claims and their legal equivalents, and not by the examples given.

I claim:

1. A toothbrush, comprising:

a handle sized and shaped for providing a comfortable and secure grip, a plurality of bristles mounted on the distal end of a head extending from a forward end of said handle, light source means positioned in said handle for projecting a light beam across an open space external of said handle and said head generally and onto said bristles to illuminate said bristles and an area adjacent said bristles, power supply means for energizing said light source means.

2. The toothbrush of claim 1 wherein said light source means comprises an incandescent light bulb.

3. The toothbrush of claim 1 wherein said light source means comprises a light emitting diode.

4. The toothbrush of claim 1 wherein said power supply means comprises a battery housed within said handle.

5. The toothbrush of claim 1, further including a switch means comprising a bow spring attached externally to said handle, and a plunger attached generally to the center of said bow spring, such that said bow spring and said plunger are easily compressed when said handle is held in a hand.

6. The toothbrush of claim 1, further including a hook extending from said handle for hanging said toothbrush.

7. The toothbrush of claim 1 wherein said head and said bristles are detachable from said handle for easy and economical replacement.

8. The toothbrush of claim 1 wherein said bristles comprise elongated, thin nylon filaments.

9. A toothbrush, comprising:

a handle sized and shaped for providing a comfortable grip, a plurality of bristles mounted on the distal end of a head extending from the forward end of said handle, light source means positioned in said handle for projecting a light beam across an open space external of said handle and said head generally onto the external surfaces of said bristles for illuminating said bristles, and when said bristles are placed against the teeth in a mouth, said light beam is also projected onto the surfaces of said teeth and the plaque on said teeth for improving the visibility of said teeth and said plaque for more efficient brushing, power supply means for energizing said light source means.

10. The toothbrush of claim 9 wherein said light source means comprises an incandescent light bulb.

11. The toothbrush of claim 9 wherein said light source means comprises a light emitting diode.

12. The toothbrush of claim 9 wherein said power supply means comprises a battery housed within said handle.

13. The toothbrush of claim 9, further including a switch means comprising a bow spring attached externally to said handle, and a plunger attached generally to the center of said bow spring, such that said bow spring and said plunger are easily compressed when said handle is held in a hand.

14. The toothbrush of claim 9, further including a hook extending from said handle for hanging said toothbrush.

15. The toothbrush of claim 9 wherein said head and said bristles are detachable from said handle for easy and economical replacement.

16. The toothbrush of claim 9 wherein said bristles comprise elongated, thin nylon filaments.

17. A toothbrush, comprising:

a handle sized and shaped for providing a comfortable grip, a plurality of bristles mounted on the distal end of a head extending from the forward end of said handle, light source means comprising an incandescent light bulb positioned in said handle for projecting a light beam across an open space external of said handle and said head generally onto the external surfaces of said bristles for illuminating said bristles, and when said bristles are placed against the teeth in a mouth, said light beam is also projected onto the surfaces of said teeth and the plaque on said teeth for improving the visibility of said teeth and said plaque for more efficient brushing, power supply means comprising a battery housed in said handle for energizing said light source means.

18. The toothbrush of claim 17, further including a hook extending from said handle for hanging said toothbrush.

19. The toothbrush of claim 17 wherein said head and said bristles are detachable from said handle for easy and economical replacement.

20. The toothbrush of claim 17 wherein said bristles comprise elongated, thin nylon filaments.

* * * * *